US011434041B2

(12) United States Patent
Imanari

(10) Patent No.: US 11,434,041 B2
(45) Date of Patent: Sep. 6, 2022

(54) PACKING MEMBER FOR ELECTRONIC DEVICE

(71) Applicant: CANON KABUSHIKI KAISHA, Tokyo (JP)

(72) Inventor: Hiroshi Imanari, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 43 days.

(21) Appl. No.: 17/173,112

(22) Filed: Feb. 10, 2021

(65) Prior Publication Data

US 2021/0253296 A1 Aug. 19, 2021

(30) Foreign Application Priority Data

Feb. 18, 2020 (JP) ..... JP2020-025631

(51) Int. Cl.
*B65D 81/113* (2006.01)
*B65D 5/50* (2006.01)
*B65D 77/26* (2006.01)

(52) U.S. Cl.
CPC ..... *B65D 5/50* (2013.01); *B65D 77/26* (2013.01); *B65D 81/113* (2013.01)

(58) Field of Classification Search
CPC ..... B65D 5/50; B65D 77/26; B65D 69/00; B65D 81/05; B65D 81/057; B65D 81/107
USPC ..... 206/320, 576, 594, 592
See application file for complete search history.

(56) References Cited

U.S. PATENT DOCUMENTS

2006/0226046 A1* 10/2006 Matsumoto ..... B65D 19/38 206/600
2007/0187283 A1* 8/2007 Otsuka ..... B65D 81/113 206/320
2012/0085678 A1* 4/2012 Yoshida ..... B65D 5/509 206/592
2012/0097569 A1* 4/2012 Murano ..... B65D 77/04 206/523
2014/0319011 A1* 10/2014 Noguchi ..... B65D 5/5035 206/521
2015/0353269 A1* 12/2015 Sato ..... B65D 85/38 206/316.1

(Continued)

FOREIGN PATENT DOCUMENTS

JP 2003-026246 1/2003

*Primary Examiner* — Jacob K Ackun
(74) *Attorney, Agent, or Firm* — Venable LLP

(57) ABSTRACT

A packing member for an electronic device includes a packing box for accommodating the electronic device, an accommodating container for accommodating an article packed together with the electronic device, and a cushioning material, including a recessed accommodating portion for accommodating the accommodating container, for holding the electronic device in a state in which the cushioning material is provided between an inner wall of the packing box and the electronic device and in which the electronic device is separated from the inner wall inside the packing box. The cushioning material sandwiched between the accommodating container accommodated in the recessed accommodating portion and the electronic device includes a first cushioning portion contacting the accommodating container and a second cushioning portion separated from the accommodating container by providing a stepped portion from the first cushioning portion toward the electronic device.

7 Claims, 9 Drawing Sheets

(56) References Cited

U.S. PATENT DOCUMENTS

2016/0107789 A1* 4/2016 Itano ..... B65D 5/32
206/386

* cited by examiner (a)

(b)

PACKING MEMBER FOR ELECTRONIC DEVICE

FIELD OF THE INVENTION AND RELATED ART

The present invention relates to a packing member for an electronic device.

In general, during transportation of the electronic device such as an image forming apparatus, in order to protect the electronic device from an external impact, a constitution in which the electronic device is covered with a cushioning material such as expanded polystyrene (styrene frame) or corrugated cardboard and then is accommodated in a packing box is employed. Further, in order to prevent articles, such as a cable and a CD, packed together with the electronic device from dispersing during the transportation, a constitution in which the articles are accommodated in an accommodating container such as a dedicated box or a dedicated tray and then are accommodated in the packing box is employed (Japanese Laid-Open Patent Application 2003-26246).

In a conventional constitution, from viewpoints of costs of manufacturing and transportation, the cushioning material is desired to be a minimum size in a range in which the electronic device is protected from a force externally exerted on the electronic device during the transportation. In the case where a space for accommodating the accommodating container in the cushioning material is provided, a volume of the cushioning material is provided, a volume of the cushioning material is decreased, with the result that cushioning power of the cushioning material for decreasing the external force is also decreased.

SUMMARY OF THE INVENTION

A principal object of the present invention is to provide a packing member for an electronic device capable of decreasing a force externally exerted on a packing member during transportation while suppressing an increase in size of the packing member even in a constitution in which an accommodating container is accommodated inside a packing box.

According to an aspect of the present invention, there is provided a packing member for an electronic device, comprising: a packing box configured to accommodate the electronic device; an accommodating container configured to accommodate an article packed together with the electronic device; and a cushioning material including a recessed accommodating portion for accommodating the accommodating container and configured to hold the electronic device in a state in which the cushioning material is provided between an inner wall of the packing box and the electronic device and in which the electronic device is separated from the inner wall inside the packing box, wherein the cushioning material sandwiched between the accommodating container accommodated in the recessed accommodating portion and the electronic device includes a first cushioning portion contacting the accommodating container and a second cushioning portion separated from the accommodating container by providing a stepped portion from the first cushioning portion toward the electronic device.

Further features of the present invention will become apparent from the following description of exemplary embodiments with reference to the attached drawings.

Figure 4:
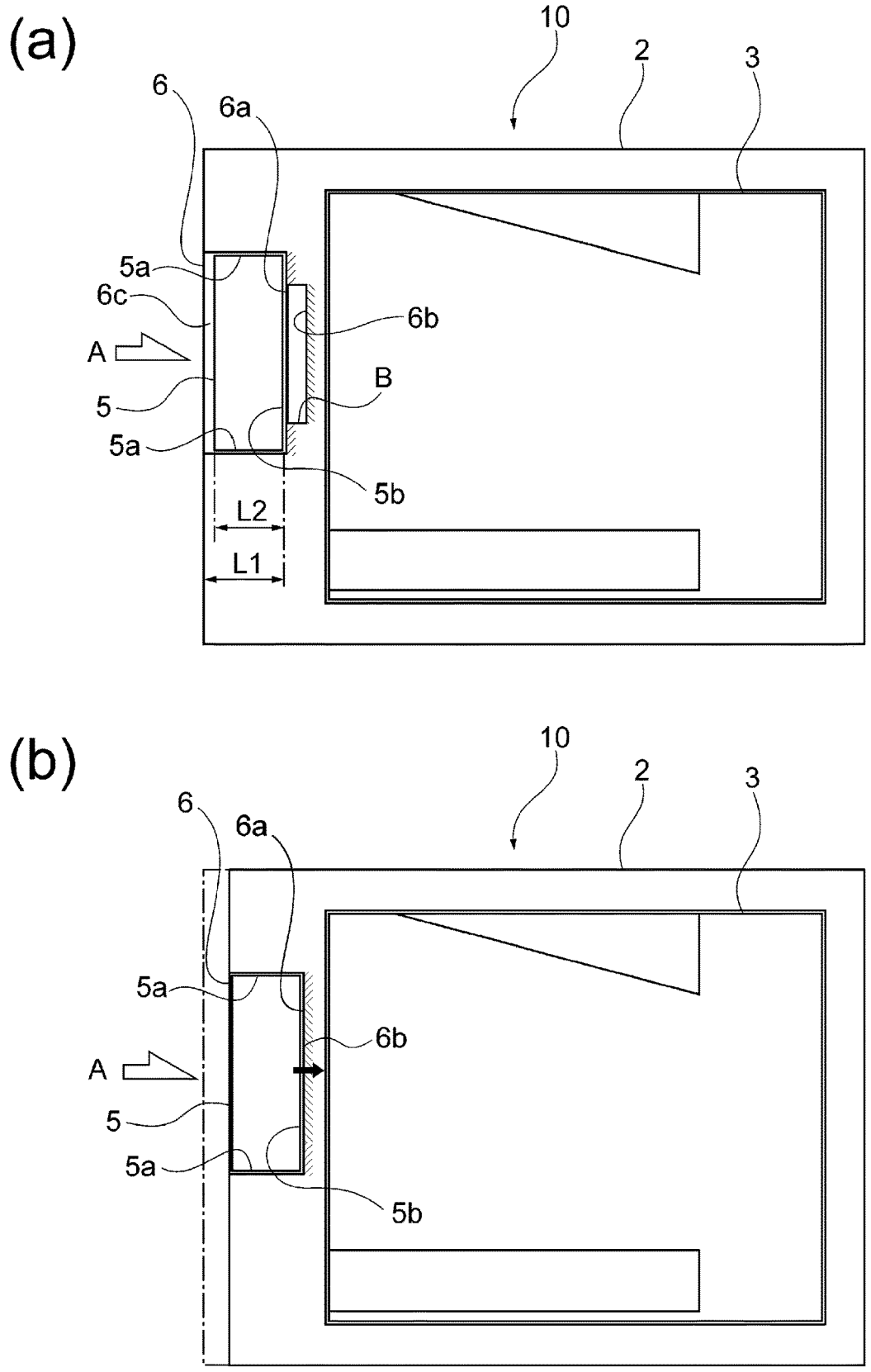

Parts (a) and (b) of FIG. 4 are schematic views showing action of a cushioning surface during a drop of the packing member according to the embodiment 1.

Figure 5:
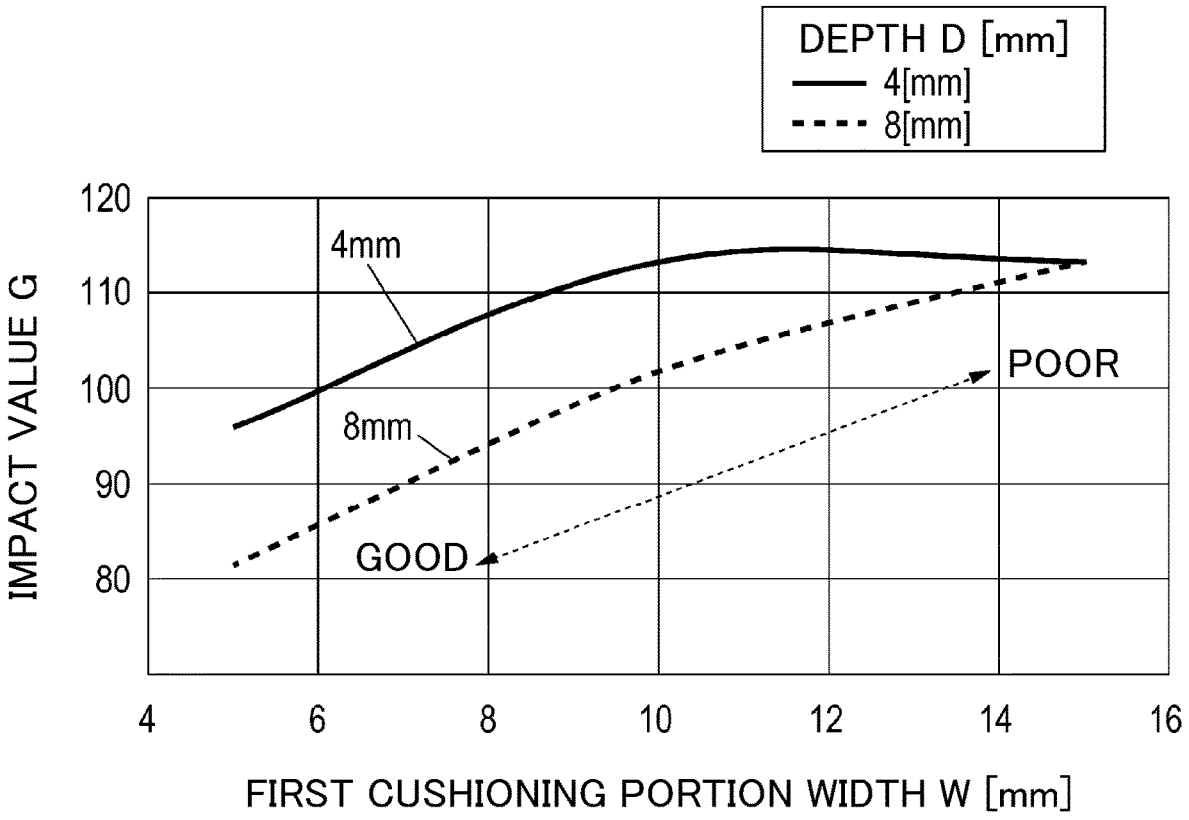

FIG. 5 is a graph showing an effect of the cushioning surface of the packing member according to the embodiment 1.

Figure 6:
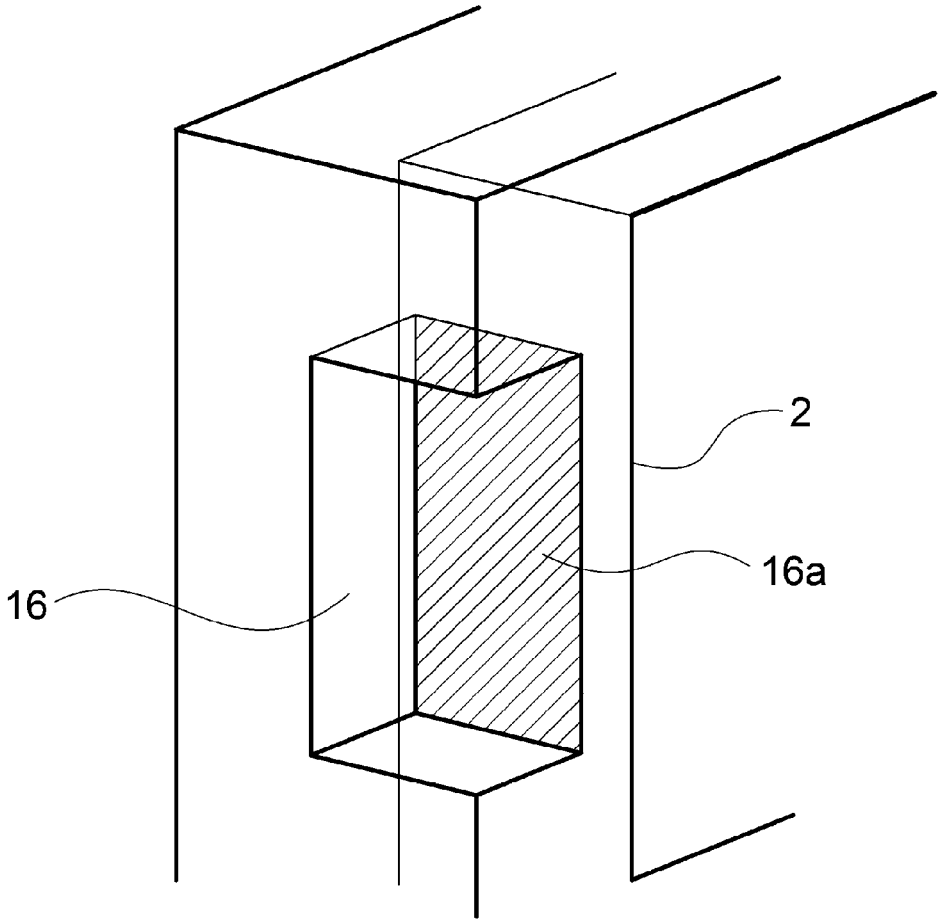

FIG. 6 is a schematic view for illustrating a structure of a recessed accommodating portion of a packing member according to a comparison example.

Figure 7:
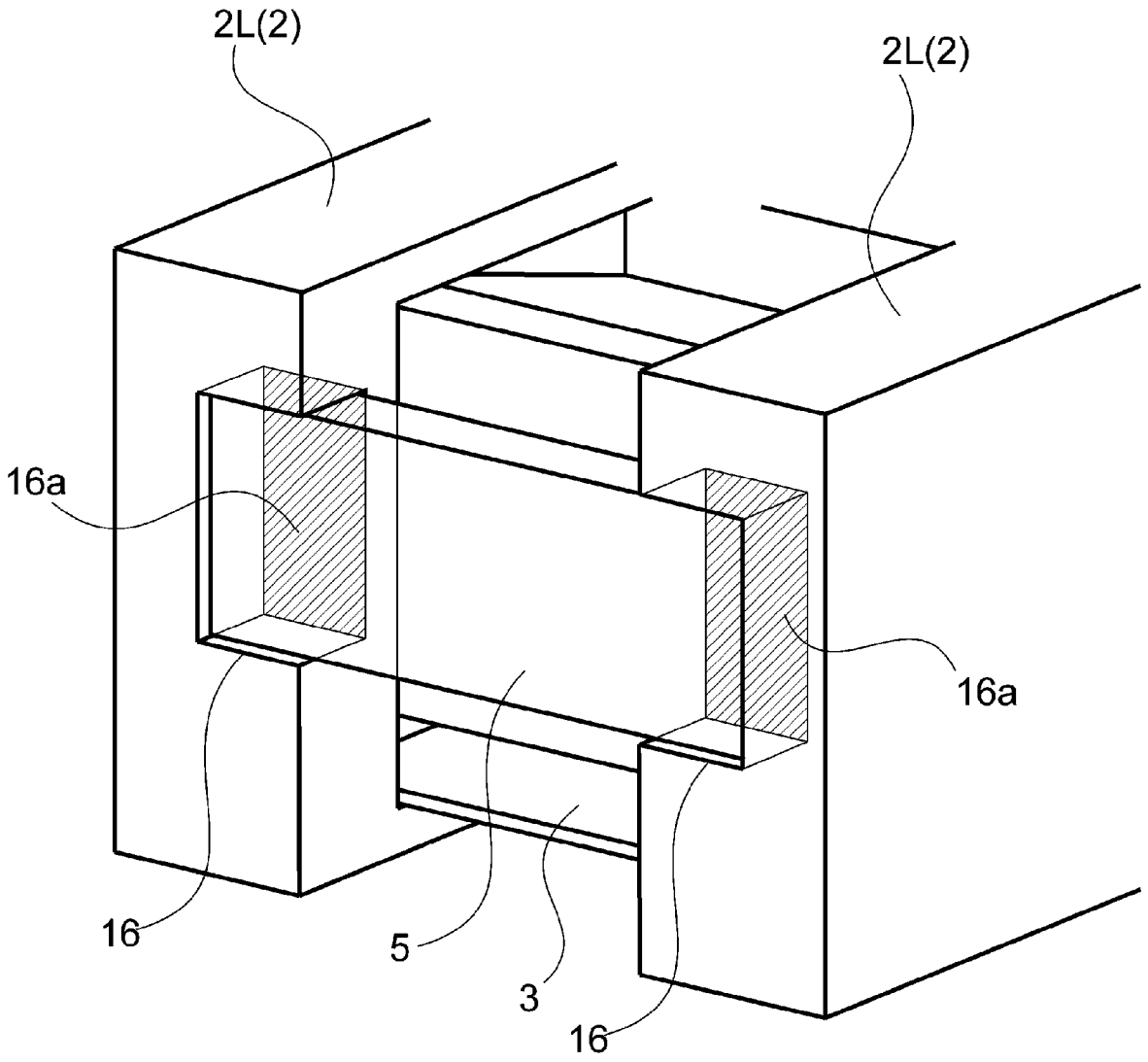

FIG. 7 is a schematic view showing a packed state of an inside of the packing member according to the comparison example.

Figure 8:
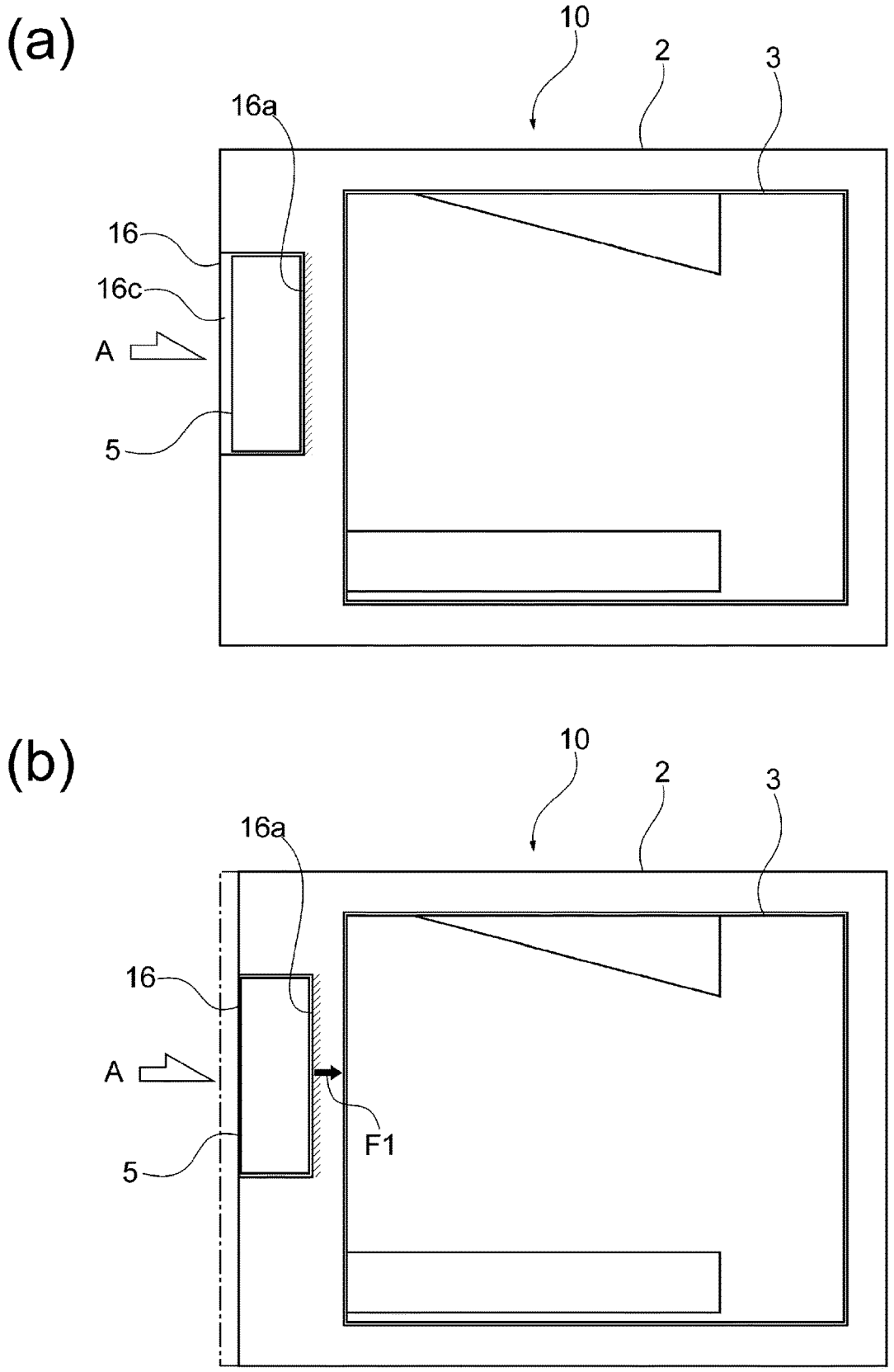

Parts (a) and (b) of FIG. 8 are schematic views showing action of a cushioning surface during a drop of the packing member according to the comparison example.

Figure 9:
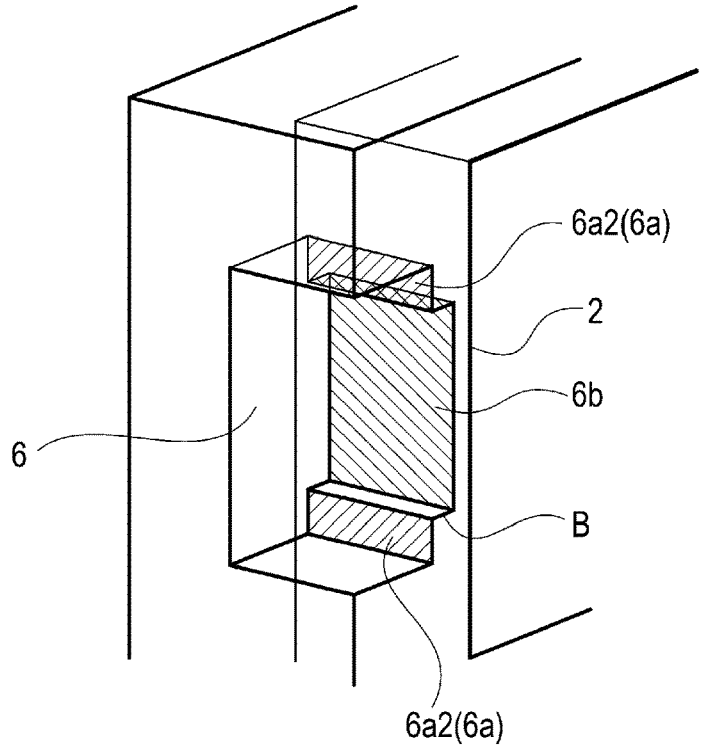
Figure 9:
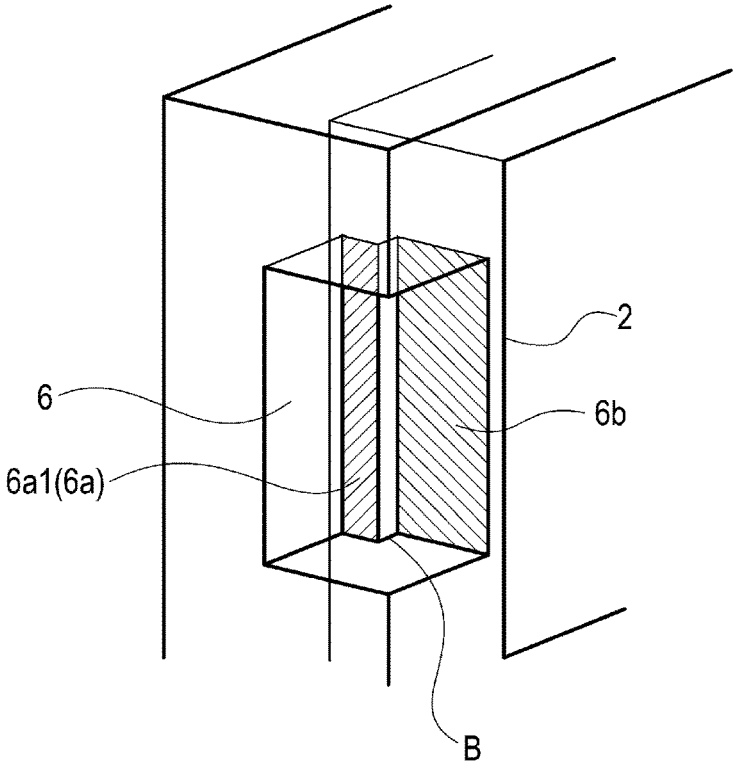

Parts (a) and (b) of FIG. 9 are schematic views each for illustrating a structure of a recessed accommodating portion of a packing member according to another embodiment.

DESCRIPTION OF THE EMBODIMENTS

Embodiments of the present invention will be specifically described with reference to the drawings. Dimensions, materials, shapes and relative arrangement of constituent elements described in the following embodiments should be appropriately be changed depending on structures and various condition of electronic devices to which the present invention is applied, and the scope of the present invention is not intended to the limited thereto.

Embodiment 1

Figure 1:
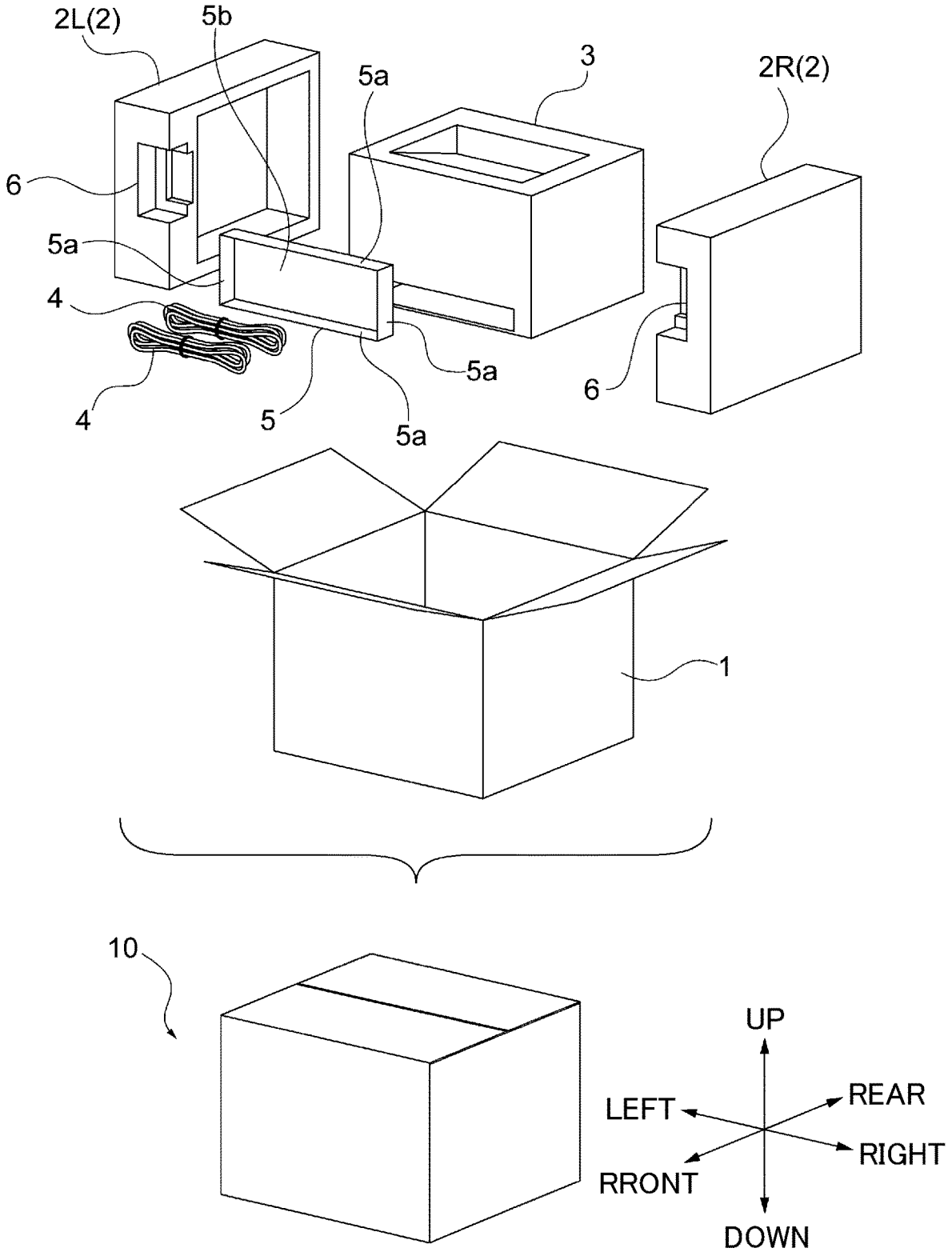
FIG. 1 is a schematic view of entirety of a packing member for an electronic device according to an embodiment 1.

A packing member for the electronic device according to an embodiment 1 will be described with reference to the drawings. First, a general structure of the packing member will be described with reference to FIG. 1. FIG. 1 is a perspective schematically showing the general structure of a packing member 10 according to the embodiment 1.

(Packing Member)

The packing member 10 includes a packing box 1 in which an electronic device 3 is accommodated, and an accommodating tray as an accommodating container in which accessories such as a power (source) cable and a driver CD which are articles packed together with the electronic device 3.

Here, as the electronic device 3, there is an electrophotographic image forming apparatus or the like for forming an image on a recording material (medium) by using an electrophotographic type. As an example of the electrophotographic image forming apparatus, an electrophotographic copying machine, an electrophotographic printer (for example, a laser beam printer, an LED printer), a facsimile machine, a word processor and the like are included.

The packing box 1 packs the electronic device 3 such as the electrophotographic image forming apparatus, and also packs the accessories 4 such as the power cable and the driver CD together with the electronic device 3. At this time, in order to prevent the accessories 4 to disperse in the packing box 1, the accessories 4 are accommodated in the accommodating tray 5 and are accommodated together with the electronic device 3.

In this embodiment, the accommodating tray 5 is formed of corrugated cardboard. The accommodating tray 5 is formed in a shape such that a periphery of a bottom 5*b* is enclosed by an outer edge portion 5*a*.

A cushioning material 2 includes a first cushioning material 21 provided between the electronic device 3 and one inner wall of the packing box 1 and a second cushioning material 2R provided between the electronic device 3 and the other inner wall of the packing box 1 opposing the one inner wall. The first cushioning material 2L which is one cushioning material is mounted on one side of the electronic device 3, and the second cushioning material 2R which is the other cushioning material is mounted on the other side opposing the one side, and these cushioning materials are accommodated in the packing box 1. By this, the packing members 2 (2L, 2R) are disposed inside the packing box 1 between the electronic device 3 and each of the opposite inner walls of the packing box 1, and holds the electronic device 1 inside the packing box 1 in a state in which the electronic device 3 is separated from the inner walls of the packing box 1. Thus, the electronic device 3 is protected from an externally applied force for mounting the cushioning materials 2, formed of a foamed resin material (expanded polystyrene), from left and right sides and then by accommodating the cushioning materials 2 in the packing box 1.

Incidentally, a direction in which the cushioning materials 2 are mounted to the electronic device 3 is not limited to a left-right direction in which the cushioning materials 2 are mounted on opposite sides of the electronic device 3 shown in FIG. 1. For example, the present invention is also applicable to constitutions in which the cushioning materials 2 are mounted to the electronic device 3 on opposite sides with respect to a front-rear direction or an up-down direction, or a combination of these directions.

Here, with respect to the packing box 1, a front side (front surface side) refers to a side where the accommodating tray 5 is disposed, and a rear side (rear surface side) refers to an opposite side thereto. Further, left and right refer to left and right, respectively, in the case where the packing box 1 is viewed from the front side. Further, up and down (upper and lower) refer to up and down (upper and lower), respectively, in the case where the packing box 1 is viewed from the front side, and a top surface side refers to an upper side and a bottom side which is an opposing side (opposite side) thereto refers to a lower side. Herein, the left-right direction in the case where the packing box 1 is viewed from the front side refers to a first direction, and the up-down direction in the case where the packing box 1 is viewed from the front side refers to a second direction perpendicular to the first direction. Further, the front-rear direction of the packing box 1 refers to a third direction perpendicular to the first direction and the second direction.

Further, each of the cushioning materials 2 includes a recessed accommodating portion 6 in which the accommodating tray 5 as an accommodating container is accommodated. A structure of the recessed accommodating portion 6 will be described.

(Recessed Accommodating Portion)

Figure 2:
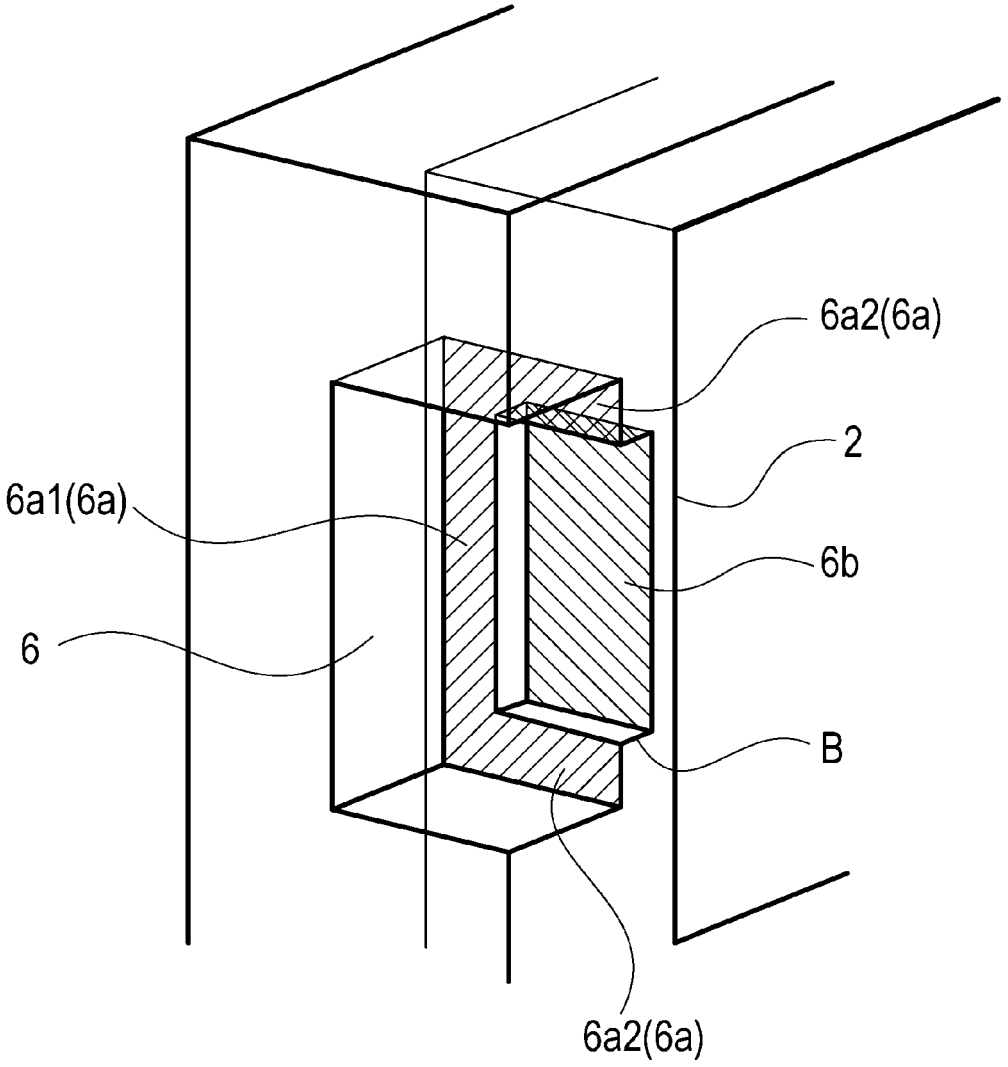
FIG. 2 is a schematic view for illustrating a structure of a recessed accommodating portion of the packing member according to the embodiment 1.

The structure of the recessed accommodating portion 6 provided on the cushioning material 2 will be described with reference to FIGS. 1 and 2. FIG. 2 is a perspective view showing the structure of the recessed accommodating portion 6 provided on the front side of the first cushioning material 2L which is one cushioning material. Incidentally, in FIG. 2, only the first cushioning material 2L which is the one cushioning material is shown and described, but as shown in FIG. 1, the second cushioning material 2R is also provided with the recessed accommodating portion 6 which is symmetrically with the recessed accommodating portion 6 of the first cushioning material 2L with respect to the left-right direction.

The cushioning material 2 sandwiched between the electronic device 3 and the accommodating tray 5 accommodated in the recessed accommodating portion 6 includes a first cushioning portion 6*a* contacting the accommodating tray 5 and a second cushioning portion 6*b* separated from the accommodating tray 5 by providing a stepped portion B from the first cushioning portion 6*a* on the electronic device side.

Further, as described above, the recessed accommodating portion 6 including the first cushioning portion 6*a* and the second cushioning portion 6*b* is provided not only on the front side of the first cushioning material 2L which is the one cushioning material but also similarly on the front side of the second cushioning material 2R which is the other cushioning material. For that reason, the accommodating tray 5 extends over the first cushioning material 2L and the second cushioning material 2R and is accommodated between the recessed accommodating portion 6 of the first cushioning material 2L and the recessed accommodating portion 6 of the second cushioning material 2R (see FIG. 3).

Further, in the recessed accommodating portion 6, the second cushioning portion 6*b* separated from the accommodating tray 5 is provided inside the first cushioning portion 6*a* contacting the accommodating tray 5. Further, in the recessed accommodating portion 6, the first cushioning portion 6*a* contacting the accommodating tray 5 is disposed along the outer edge portion 5*a* of the accommodating tray 5 (see FIG. 3). Specifically, the first cushioning portion 6*a* is provided at each of end portions 6*a*1 with respect to the first direction (left-right direction) through the second cushioning portions 6*b* and at each of end portions 6*a*2 on each of opposite sides with respect to the second direction (up-down direction).

Further, with respect to a direction from an outside toward an inside of the cushioning material 2 (arrow A direction), a length L1 from an outer wall of the cushioning material 2 where the recessed accommodating portion 6 is provided, to the first cushioning portion 6*a* is longer than a length L2 of the accommodating tray 5 accommodated in the recessed accommodating portion 6 (see FIG. 4). In this embodiment, the length L2 with respect to the arrow A direction is a length of the outer edge portion 5*a* of the accommodating tray 5. By this, between the outer wall of the cushioning material 2 and the accommodating tray 5 accommodated in the recessed accommodating portion 6, a gap region 6*c* is formed by the cushioning material 2. For this reason, even when a force is externally applied to a portion where the accommodating tray 5 of the packing box 1 is accommodated, impact is absorbed by collapse of the cushioning material 2 in the gap region 6*c*.

(Action of Cushioning Portion in Recessed Accommodating Portion)

Next, in comparison with a packing member according to a comparison example, action of the first cushioning portion and the second cushioning portion in the recessed accommodating portion of the packing member according to the first embodiment will be described.

First, action of cushioning materials in recessed accommodating portions of the packing member according to the comparison example will be described with reference to FIGS. 6 to 8. FIGS. 6 to 8 are schematic views each for illustrating the packing member according to the comparison example. FIG. 6 is the schematic view for illustrating the recessed accommodating portion of the packing member according to the comparison example. FIG. 7 is the schematic view showing a packed state of an inside of the packing member according to the comparison example. Parts (a) and (b) of FIG. 8 are the schematic views showing action of a comparison example surface during a drop of the packing member according to the comparison example.

As shown in FIGS. 6 and 7, each of the cushioning materials 2 (2L, 2R) of the packing member according to the comparison example is provided with a recessed accommodating portion 16 in which the accommodating tray 5 is accommodated. In the recessed accommodating portion 16, the cushioning material 2 disposed between the accommodating tray 5 and the electronic device 3 only includes cushioning portion 16*a* contacting the accommodating tray 5. In the recessed accommodating portion 16 of the cushioning materials 2 (2L, 2R) provided on opposite sides of the packing member according to the comparison example, the accommodating tray 5 is accommodated and contacts the cushioning portion 16*a*. Incidentally, in the packing member of the comparison example, constituent elements other than the recessed accommodating portion 16 are similar to those in the embodiment 1, and therefore, members having similar functions are represented by the same reference numerals or symbols.

As shown in part (a) of FIG. 8, when a force is exerted on a region, where the accommodating tray 5 of an unshown packing box is disposed, from an arrow A direction by a front side drop or the like, the cushioning materials 2 in the gap region 16*c* are collapsed from a state of part (a) of FIG. 8 as shown in part (b) of FIG. 8. By this, a force transmitted to the cushioning materials 2 from an outside toward an inside of the packing box is absorbed by the cushioning materials 2 in the gap region 16*c*. However, in the case where the external force remains in the packing box without being absorbed by the cushioning materials 2, a remaining force F1 without being absorbed by the cushioning materials 2 is transmitted to the electronic device 3. That is, the presence of the accommodating tray 5 prevents collapse of the cushioning materials 2, so that the force F1 remaining in the packing box without being absorbed by the cushioning materials 2 is transmitted to the electronic device 3 through the accommodating tray 5. Then, compared with the case where the external force is exerted on a portion where the accommodating tray 5 is not provided, a possibility of breakage or the like of the electronic device 3 increases. Further, at this time, in order to decrease the force F1, there was a need to take countermeasures such that cushioning power of the cushioning materials 2 is enhanced by upsizing the cushioning materials 2 and that a constitution of the electronic device 3 is made strong against the impact, thus leading to increase in transportation cost and manufacturing cost.

Therefore, in this embodiment, the cushioning material 2 at a portion sandwiched between the electronic device 3 and the accommodating tray 5 accommodated in the recessed accommodating portion 6, the first cushioning portion 6*a* contacting the accommodating tray 5 and the second cushioning portion 6*b* separated (spaced) from the accommodating tray 5 by providing the stepped portion B.

Figure 3:
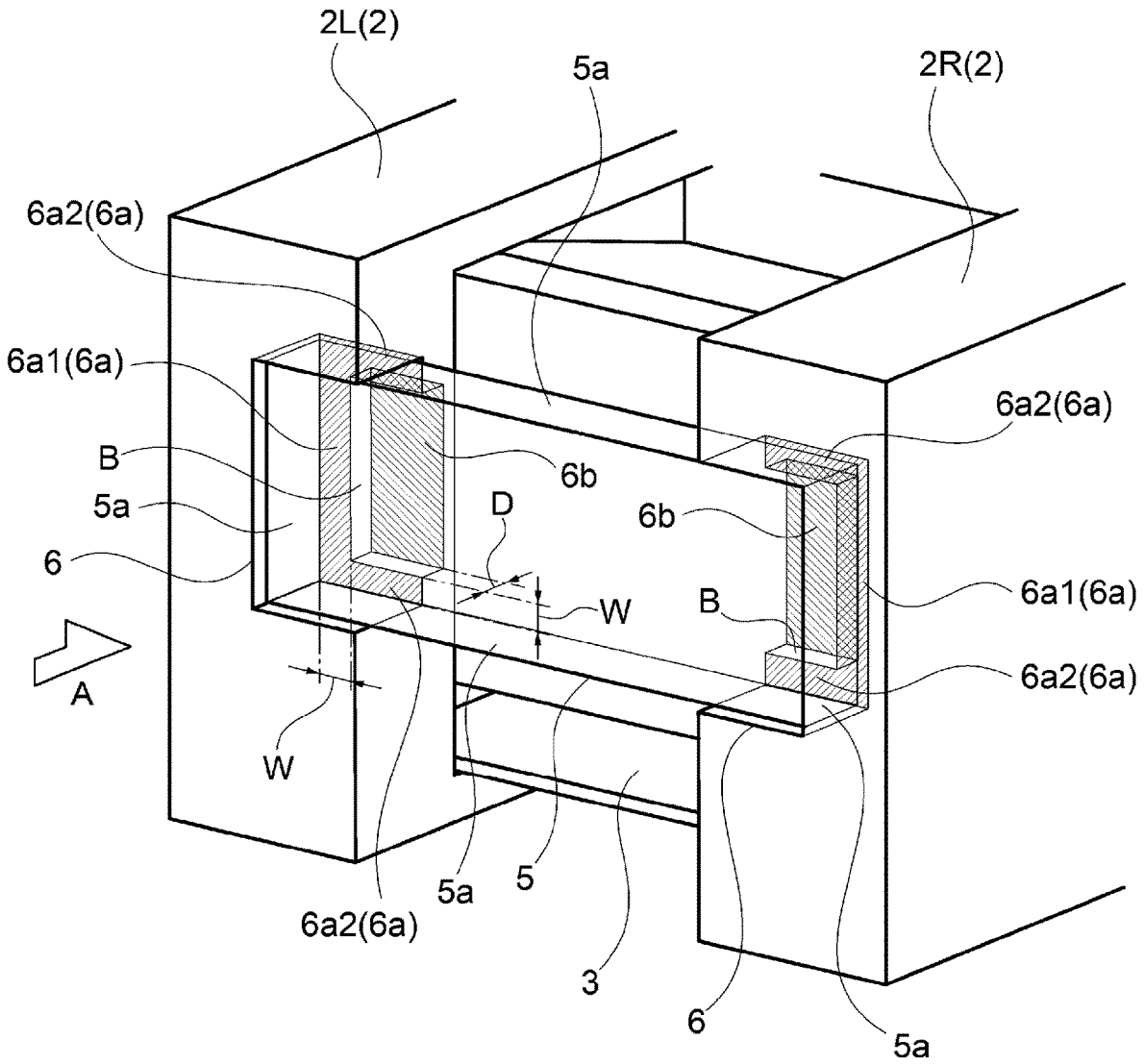
FIG. 3 is a schematic view showing a packed state of an inside of the packing member according to the embodiment 1.

With reference to FIGS. 3 and 4, action of the cushioning material in the recessed accommodating portion of the packing member according to the embodiment 1 will be described. FIGS. 3 and 4 are schematic views for illustrating the packing member according to the embodiment 1. FIG. 3 is the schematic view showing a packed state of an inside of the packing member according to the embodiment 1. Parts (a) and (b) of FIG. 4 are schematic views showing action of a cushioning surface during a drop of the packing member according to the embodiment 1.

As shown in FIG. 3, the cushioning materials 2 of the packing member 10 are provided so that the second cushioning portions 6*b* of the recessed accommodating portions 6 are provided at positions recessed from the first cushioning portions 6*a* with the stepped portion B as described above. In each of the recessed accommodating portions 6, the first cushioning portion 6*a* contacting the accommodating tray 5 is provided outside the second cushioning portion 6*b* separated (spaced) from the accommodating tray 5 and is disposed along the outer edge portion 5*a* at a position opposing the outer edge portion 5*a*.

As shown in part (a) of FIG. 4, when a force is exerted on a region, where the accommodating tray 5 of an unshown packing box is disposed, from an arrow A direction by a front side drop or the like, the cushioning materials 2 in the gap region 6*c* is collapsed, so that the external force is decreased. Here, in the case where the external force remains in the packing box without being absorbed by the cushioning materials 2, the remaining force F1 without being absorbed by the cushioning materials 2 is transmitted to the accommodating tray 5 after the cushioning materials 2 in the gap region 6*c* are collapsed, and then is transmitted to the first cushioning portions 6*a* through the outer edge portion 5*a* of the accommodating tray 5. In the recessed accommodating portion 6 in the embodiment 1 is provided with the second cushioning portions 6*b* separated from the first cushioning portions 6*a* by the stepped portion B, and therefore, a width of the first cushioning portions 6*a* is narrower than a width of the cushioning portions 16*a* in the comparison example. That is, the first cushioning portions 6*a* in the embodiment 1 are smaller in contact area with the accommodating tray 5 than the cushioning portions 16*a* in the comparison example. For the reason, the first cushioning portions 6*a* in the embodiment 1 is liable to be collapsed compared with the cushioning portions 16*a* in the comparison example, so that cushioning power of the cushioning materials 2 between the accommodating tray 5 and the electronic device 3 is higher than cushioning power of the cushioning materials 2 in the comparison example. Further, the external force F1 which has not been completely absorbed by the first cushioning portions 6*a* is further absorbed by the second cushioning portions 6*b* by contact of the accommodating tray 5 with the second cushioning portions 6*b* as shown in part (b) of FIG. 4, and thus is transmitted as a force F2 to the electronic device 3.

At this time, the force F2 transmitted to the electronic device 3 is further made smaller by the action of the first cushioning portions 6*a* than the force F1 decreased by the cushioning materials 2 in the gap region 6*c* is, so that F1>F2 is satisfied.

Thus, in this embodiment, in each of the recessed accommodating portions 6 for accommodating the accommodating tray 5, the first cushioning portion 6*a* contacting the accommodating tray 5 and the second cushioning portion 6*b* separated from the accommodating tray 5 by providing the stepped portion B are provided. By this, in addition to the action of absorbing the external force by the cushioning material 2 in the gap region 6*c*, the action of further absorbing the external force by the first cushioning portion 6*a* generates, so that it is possible to decrease the transmission of the external force to the electronic device 3.

In FIG. 5, a result of simulation of an impact value G transmitted to the electronic device in the packing member in the case where the packing member according to this embodiment is dropped from the same height (level) by changing a width W [mm] (see FIG. 3) of the first cushioning portion 6*a* and a depth D [mm] (see FIG. 3) of the stepped portion B is shown. In FIG. 5, the ordinate represents the impact value G (increment: 10G) of the impact transmitted to the electronic device accommodated in the packing member, and the abscissa represents the width W [mm] of the first cushioning portion 6*a*. In FIG. 5, a solid line represents the case where the depth D [mm] of the stepped portion B is 4 [mm], and a broken line represents the case where the depth D [mm] of the stepped portion B is 8 [mm]. In the result of the simulation shown in FIG. 5, the impact value Gin the case where the width W of the first cushioning portion 6*a* is 5 [mm] and the depth of the stepped portion B is 4 [mm] is about 95 G. Further, the impact value G in the case where the width of the first cushioning portion 6*a* is 5 [mm] and the depth of the stepped portion B is 8 [mm] is about 80 G. As is understood from the result of the simulation shown in part (a) of FIG. 5, an effect of further decreasing the impact value G can be obtained with a decreasing width W [mm] of the first cushioning portion 6*a* and with an increasing depth D [mm] of the stepped portion B. That is, as the width W [mm] of the first cushioning portion 6*a* becomes small, the effect of further decreasing the external force is obtained, and as the depth D [mm] of the stepped portion B becomes large, the effect of further decreasing the external force is obtained.

Other Embodiments

In the above-described embodiments, the constitution in which the first cushioning portions 6*a* are provided along the outer edge portion 5*a* of the accommodating tray 5 accommodated in the recessed accommodating portions 6 was described as an example, but the present invention is not limited thereto. As shown in part (a) of FIG. 9, a constitution in which the first cushioning portions 6*a* are provided through the second cushioning portion 6*b* at an end portion with respect to the first direction (left-right direction shown in FIG. 1) may also be employed. In the case of the constitution shown in part (a) of FIG. 9, the first cushioning portions 6*a* are provided through the second cushioning portion 6*b* on opposite sides with respect to the left-right direction by providing the first cushioning portions 6*a* of the recessed accommodating portions 6 of the cushioning materials 2 (2L, 2R) mounted on opposite sides of the electronic device with respect to the left-right direction. Or, as shown in part (b) of FIG. 9, a constitution in which the first cushioning portions 6*a* are provided through the second cushioning portion 6*b* at end portions on opposite sides with respect to the second direction (up-down direction) perpendicular to the first direction may also be employed. Even when such constitutions are employed, the effect of decreasing the external force can be obtained.

Further, in the above-described embodiment, as the electronic device, the image forming apparatus was described as an example, but the present invention is not limited thereto. For example, the electronic device may also be an image reading apparatus such as a scanner for reading an image on a sheet, such as an original, which is an object to be read. Or, the electronic device may also be a sheet processing device for subjecting a sheet to processing and a sheet feeding device for feeding the sheet, which are connected as options to the image forming apparatus. A similar effect can be achieved by applying the present invention to packing members for these electronic devices.

According to the present invention, even in the constitution in which the accommodating container is accommodated inside the packing box, the force externally exerted on the packing member during the transportation can be decreased while suppressing an increase in size of the packing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-025631 filed on Feb. 18, 2020, which is hereby incorporated by reference herein in its entirety.

What is claimed is:

1. A packing member for an electronic device, comprising:

a packing box configured to accommodate the electronic device;

an accommodating container configured to accommodate an article packed together with the electronic device; and a cushioning material including a recessed accommodating portion for accommodating said accommodating container and configured to hold the electronic device in a state in which said cushioning material is provided between an inner wall of said packing box and the electronic device and in which the electronic device is separated from the inner wall inside said packing box, wherein said cushioning material sandwiched between said accommodating container accommodated in said recessed accommodating portion and the electronic device includes a first cushioning portion contacting said accommodating container and a second cushioning portion separated from said accommodating container by providing a stepped portion from said first cushioning portion toward the electronic device.

2. A packing member according to claim 1, wherein said second cushioning portion is provided inside said first cushioning portion.

3. A packing member according to claim 2, wherein said first cushioning portion is provided along an outer edge portion of said accommodating container.

4. A packing member according to claim 2, wherein said first cushioning portion is provided through said second cushioning portion on opposite sides with respect to a first direction or on opposite sides with respect to a second direction perpendicular to the first direction.

5. A packing member according to claim 1, wherein said cushioning material is formed of a foamed resin material.

6. A packing member according to claim 1, wherein with respect to a direction form an outside toward an inside of said cushioning material, a length from an outer wall of said cushioning material including said recessed accommodating portion to said first cushioning portion is longer than a length of said accommodating container accommodated in said recessed accommodating portion.

7. A packing member according to claim 1, wherein said cushioning material includes a first cushioning material provided between the electronic device and one inner wall of said packing box and a second cushioning material provided between the electronic device and the other inner wall of said packing box opposing said one inner wall, and wherein said accommodating container is provided over between said recessed accommodating portion provided in said first cushioning material and said recessed accommodating portion provided in said second cushioning material.

* * * * *